US007659834B2

(12) United States Patent
Young et al.

(10) Patent No.: US 7,659,834 B2
(45) Date of Patent: Feb. 9, 2010

(54) DIRECT WIRELESS POLLING OF MODEL TRAINS

(75) Inventors: Neil Percibal Young, Redwood City, CA (US); Louis G. Kovach, II, Belleville, MI (US)

(73) Assignee: Liontech Trains LLC, Chesterfield, MI (US)

( * ) Notice: Subject to any disclaimer, the term of this patent is extended or adjusted under 35 U.S.C. 154(b) by 110 days.

(21) Appl. No.: 10/723,430

(22) Filed: Nov. 25, 2003

(65) Prior Publication Data

US 2005/0110653 A1 May 26, 2005

(51) Int. Cl.
*G08C 19/00* (2006.01)

(52) U.S. Cl. ..... 340/825.72; 340/825.69; 340/825.52; 340/10.51; 340/5.64; 105/1.5; 105/29.2

(58) Field of Classification Search ..... 340/5.23, 340/5.25, 825.69, 825.72, 825.52; 464/454, 464/467; 398/106, 156; 105/1.5, 29.2
See application file for complete search history.

(56) References Cited

U.S. PATENT DOCUMENTS 4,335,381 A * 6/1982 Palmer ..... 340/825.21
4,349,196 A 9/1982 Smith et al.
4,970,389 A 11/1990 Danforth et al.
5,077,547 A * 12/1991 Burgmann ..... 340/825.72
5,492,290 A 2/1996 Quinn et al.
5,638,522 A 6/1997 Dunsmuir et al.
5,678,789 A 10/1997 Pipich
5,749,547 A * 5/1998 Young et al. ..... 340/825.69
5,803,411 A 9/1998 Ackerman et al.
5,909,183 A * 6/1999 Borgstahl et al. ..... 340/825.22
6,019,289 A 2/2000 Sung
6,133,847 A * 10/2000 Yang ..... 340/825.22
6,220,552 B1 4/2001 Ireland
6,275,739 B1 8/2001 Ireland
6,281,606 B1 8/2001 Westlake
6,318,678 B2 11/2001 Ireland
6,322,025 B1 * 11/2001 Colbert et al. ..... 246/167 R
6,367,742 B1 4/2002 Ireland
6,441,570 B1 8/2002 Grubba et al.
6,457,681 B1 10/2002 Wolf et al.
6,480,766 B2 11/2002 Hawthorne et al.
6,485,347 B1 11/2002 Grubba et al.
6,491,263 B1 * 12/2002 Sung et al. ..... 246/415 R (Continued)

OTHER PUBLICATIONS

"Astrac lets you control 5 trains on one track, in different directions, at different speeds-simultaneously," product advertisement from General Electric Corporation in Model Railroader magazine (Nov. 1963).

(Continued)

*Primary Examiner*—Vernal U Brown
(74) *Attorney, Agent, or Firm*—O'Melveny & Myers LLP

(57) ABSTRACT

A method and apparatus for designating a particular model vehicle for a command function without punching in the ID of the model vehicle. A remote control device is positioned near one of the model vehicles. A limited field transmission occurs between the model vehicle and the remote control device. The device may be a train engine transmitting its train ID periodically via an infrared (IR) transmission. The remote near the train automatically receives the IR transmission of the train ID, so that the next press of a command button will automatically go to that train ID without needing to punch in the ID number.

19 Claims, 4 Drawing Sheets

U.S. PATENT DOCUMENTS

| | | | | |
|---|---|---|---|---|
| 6,513,763 | B1 | 2/2003 | Ireland | |
| 6,533,223 | B1 | 3/2003 | Ireland | |
| 6,533,224 | B1 | 3/2003 | Ireland | |
| 6,536,716 | B1 | 3/2003 | Ireland et al. | |
| 6,539,292 | B1 | 3/2003 | Ames | |
| 6,545,886 | B1 | 4/2003 | Ireland | |
| 6,604,641 | B2 | 8/2003 | Wolf et al. | |
| 6,619,594 | B2 | 9/2003 | Wolf et al. | |
| 6,624,537 | B2 | 9/2003 | Westlake | |
| 6,655,640 | B2 | 12/2003 | Wolf et al. | |
| 6,662,917 | B1 | 12/2003 | Wolf et al. | |
| 6,729,584 | B2 | 5/2004 | Ireland | |
| 6,747,579 | B1 | 6/2004 | Ireland | |
| 6,765,356 | B1 | 7/2004 | Denen et al. | |
| 6,927,697 | B2 * | 8/2005 | Yamaguchi | 340/825.69 |
| 6,970,096 | B2 * | 11/2005 | Nagata et al. | 340/825.69 |
| 2001/0005001 | A1 | 6/2001 | Ireland | |
| 2003/0015626 | A1 | 1/2003 | Wolf et al. | |
| 2003/0127570 | A1 | 7/2003 | Ireland | |
| 2003/0142796 | A1 | 7/2003 | Ames | |
| 2004/0066277 | A1 * | 4/2004 | Murray et al. | 340/5.54 |
| 2004/0079841 | A1 | 4/2004 | Wolf et al. | |
| 2004/0239268 | A1 | 12/2004 | Grubba et al. | |
| 2005/0023416 | A1 | 2/2005 | Wolf et al. | |

OTHER PUBLICATIONS

"DCC (Digital Command Control) Standards & Recommended Practices," National Model Railroad Association, Inc. (Mar. 1997-Jul. 2004).

Gutierrez "Introducing the CTC-16: A 16-channel command control system you can build Part 1," Model Railroader pp. 64-67 (Dec. 1997).

Gutierrez "The CTC-16: A 16-channel command control system you can build Part 2," Model Railroader pp. 86-93 (Jan. 1980).

Gutierrez "The CTC-16: A 16-channel command control system you can build Part 3," Model Railroader pp. 89-92 (Feb. 1980).

Gutierrez "The CTC-16: A 16-channel command control system you can build Part 4," Model Railroader pp. 89-93 (Mar. 1980).

Gutierrez "The CTC-16: A 16-channel command control system you can build Part 5," Model Railroader pp. 71-77 (Apr. 1980).

Gutierrez et al. "The CTC-16: epilogue," Model Railroader pp. 132-136 (Dec. 1980).

Gutierrez "Build the wireless throttle 1," Model Railroader pp. 86-95 (Mar. 1983).

Gutierrez "Build the wireless throttle 2," Model Railroader pp. 68-75 (Apr. 1983).

"Infrared Control Unit," Model Railroader pp. 54-56 (Mar. 1991).

Pussel µP-programmable speed controller for model railways, Elektor (Jul./Aug. 1979).

Sperandeo "Commercial Command Control Systems," Model Railroader pp. 80-81 (Nov. 1979).

Westcott "Is Astrac on the right track?" Model Railroader pp. 33-37 (Dec. 1963).

Wigmore "The Digital Train Part 1 ," Elektor Electronics pp. 42+46 (Feb. 1989).

Wigmore "The Digital Model Train Part 2 ," Elektor Electronics pp. 50-53 (Mar. 1989).

Wigmore "The Digital Model Train Part 3 ," Elektor Electronics pp. 14-18 (Apr. 1989).

Wigmore "The Digital Model Train Part 4 ," Elektor Electronics pp. 16-17 (May 1989).

Wigmore "The Digital Model Train Part 5 ," Elektor Electronics pp. 56-59 (Jul./Aug. 1989).

Wigmore "The Digital Model Train Part 6 ," Elektor Electronics pp. 44-47 (Sep. 1989).

Wigmore "The Digital Model Train Part 7 ," Elektor Electronics pp. 21-24 (Oct. 1989).

Wigmore "The Digital Model Train Part 8 ," Elektor Electronics pp. 32-36 (Nov. 1989).

Wigmore "The Digital Model Train Part 9—Keyboards ," Elektor Electronics pp. 24-28 (Dec. 1989).

Wigmore "The Digital Model Train Part 10—RS232 Interface," Elektor Electronics pp. 38-43 (Jan. 1990).

Wigmore "The Digital Model Train Part 11—The Monotor Unit," Elektor Electronics pp. 53-55 (Feb. 1990).

Wigmore "The Digital Model Train Part 12—Address Display," Elektor Electronics pp. 52-54 (Mar. 1990).

Wigmore "The Digital Model Train Concluding Part," Elektor Electronics pp. 24-26 (Apr. 1990).

* cited by examiner

DIRECT WIRELESS POLLING OF MODEL TRAINS

CROSS-REFERENCES TO RELATED APPLICATIONS

Copending application Ser. No. 10/346,558, filed Jan. 16, 2003, describes a model train control system including sensors by the train tracks to detect the ID of passing trains.

STATEMENT AS TO RIGHTS TO INVENTIONS MADE UNDER FEDERALLY SPONSORED RESEARCH OR DEVELOPMENT

NOT APPLICABLE

REFERENCE TO A "SEQUENCE LISTING," A TABLE, OR A COMPUTER PROGRAM LISTING APPENDIX SUBMITTED ON A COMPACT DISK

NOT APPLICABLE

BACKGROUND OF THE INVENTION

The present invention relates to controlling model vehicles, and in particular to methods for obtaining the ID of model trains.

A variety of control systems are used to control model trains. In one system, the power to the track is increased, or decreased, to control the speed and direction of the train. Multiple trains can be controlled by providing different power levels to the different sections of the track having different trains (see, e.g., U.S. Pat. No. 5,638,522). In another system, a coded signal is sent along the track, and addressed to the desired train, giving it a speed and direction. The train itself controls its speed by converting the AC voltage on the track into the desired DC motor voltage for the train according to the received instructions. The instructions can also tell the train to turn on or off its lights, horns, etc. U.S. Pat. Nos. 5,749,547 and 5,638,522 issued to Neil Young et al. show such a system. The instructions, or commands, have a particular format for a particular model train manufacturer. Trains already in customer's hands are designed to respond to only that format, limiting the options for future expansion.

The arrival of a train on a section of track can be detected in some systems, such as by detecting the load on the current applied to the track, and can be used to activate certain elements connected to the track, such as a switch or a stoplight (see, e.g., U.S. Pat. No. 5,492,290).

U.S. Pat. No. 4,349,196 shows a system with a unique bar code on the bottom of each train car, with detectors mounted in the track below. This allows a determination of which car is over the sensor, and which cars have been assembled in a train. U.S. Pat. No. 5,678,789 shows a system with sensors in the track for detecting the position and velocity of a passing train. U.S. Pat. No. 4,970,389 describes a bar-code indicia in the windshield of a car, invisible to humans, but readable by an IR laser. IR IDs readable by scanners are common for bar coding products, access cards, and other uses.

U.S. Pat. No. 6,480,766 contains a discussion of different systems, including satellite Global Positioning Systems (GPS) for determining the location of a particular full sized (not model) train. U.S. Pat. No. 5,803,411 shows a train which detects position indicators along the side of a track, and provides these to an onboard computer for determining the position, speed, etc. of the train.

Many model train systems include a remote control for controlling different train engines on the track, as well as for controlling accessories. The remote control normally sends commands either wirelessly or through a base device connected to the tracks. The command will include an address, which the user typically has to key in before or after hitting the command button. Each engine sees the transmissions, either wirelessly, or by picking up signals sent along the tracks. Each engine will only respond to commands with the address of that engine.

BRIEF SUMMARY OF THE INVENTION

The present invention provides a method and apparatus for designating a particular model vehicle for a command function without punching in the ID of the model vehicle. The remote control device is positioned near one of the model vehicles. A limited field transmission occurs between the model vehicle and the remote control device. Data is then transmitted between the model vehicle and the remote control device.

In one embodiment, the model vehicle is a train and the train engine transmits its train ID, engine number and engine road name, and optionally other data, periodically via an infrared (IR) transmission. The present invention allows the user to place the remote near the train desired to be controlled, automatically receive the IR transmission of the train ID, so that the next press of a command button will automatically go to that train ID without needing to punch in the ID number.

The invention can also use other mechanisms, such as a transmission from the remote which is reflected off of an IR reflector or other reflector on the engine, with the ID coded on the reflector. This may be particularly useful for accessories without sophisticated electronics inside. In one embodiment, the receiver of the IR is recessed within the remote controller so that only a narrow field of view for reception is provided, avoiding the situation where the remote device picks up transmissions from other trains, which might occur if the IR receiver were allowed to widely receive in multiple directions.

For a further understanding of the nature and advantages for the invention, reference should be made to the following description taken in conjunction with the accompanying drawings.

DETAILED DESCRIPTION OF THE INVENTION

Example Control System

Figure 1:
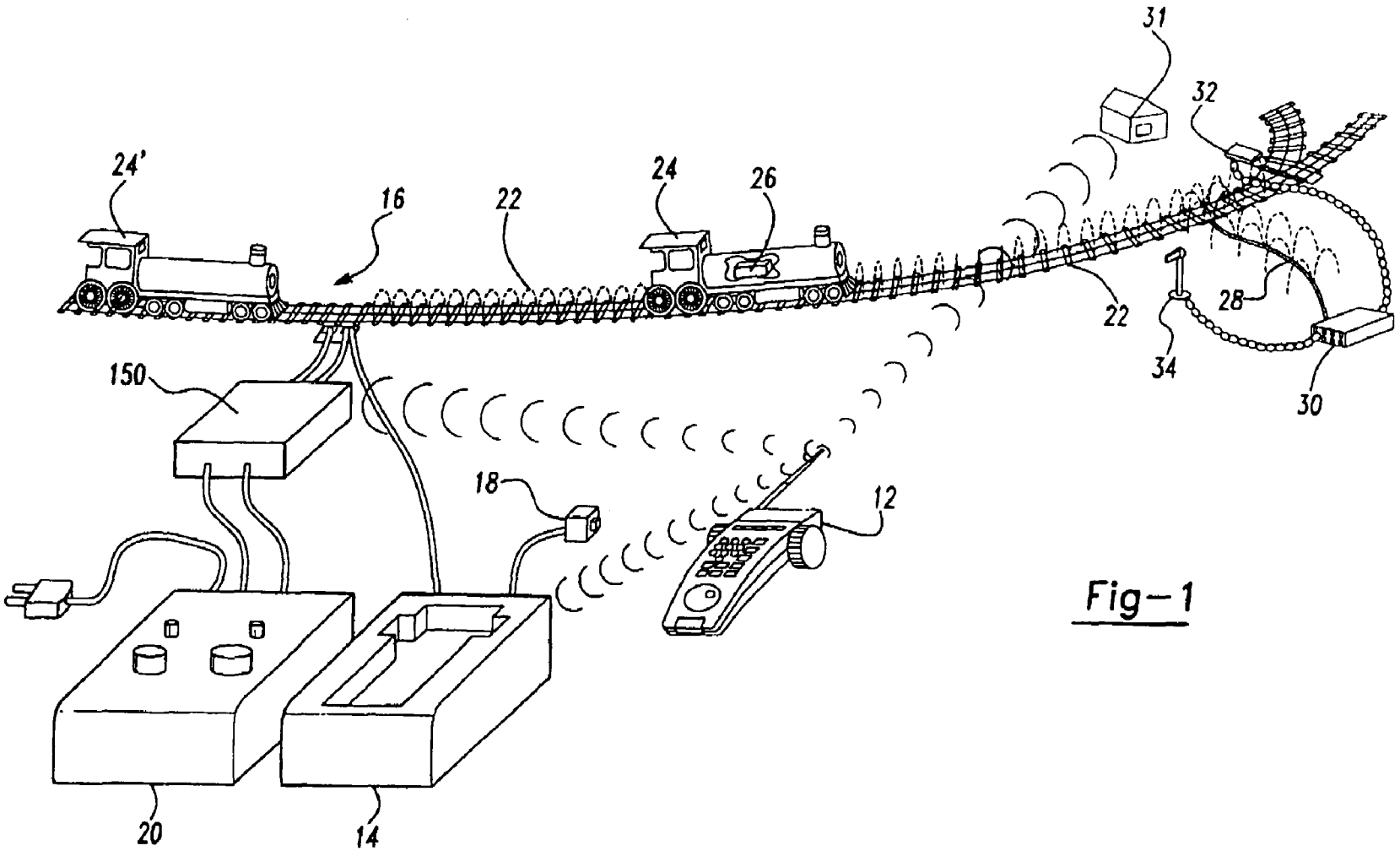
FIG. 1 is a drawing of an example layout of a train track system which could be used with the present invention.

FIG. 1 is a perspective drawing of an example layout of a train track system. A hand-held remote control unit 12 is used to transmit signals to a base unit 14 and to a power master unit 150 both of which are connected to train tracks 16. Base unit 14 receives power through an AC adapter 18. A separate transformer 20 is connected to track 16 to apply power to the tracks through power master unit 150. Power master unit 150 is used to control the delivery of power to the track 16 and also is used to superimpose DC control signals on the AC power signal upon request by command signals from the hand-held remote control unit 12.

Power master unit 150 modulates AC track power to the track 16 and also superimposes DC control signals on the track to control special effects and locomotive 24'. Locomotive 24' is, e.g., a standard Lionel locomotive powered by AC track power and receptive to DC control signals for, e.g., sound effects.

Base unit 14 transmits an RF signal between the track and earth ground, which generates an electromagnetic field indicated by lines 22 which propagates along the track. This field will pass through a locomotive 24 and will be received by a receiver 26 inside the locomotive. Locomotive 24 may be, e.g., a standard locomotive retrofitted or designed to carry a special receiver 26.

The electromagnetic field generated by base unit 14 will also propagate along a line 28 to a switch controller 30. Switch controller 30 also has a receiver in it, and will itself transmit control signals to various devices, such as the track switching module 32 or a moving flag 34.

The remote unit can transmit commands wirelessly to base unit 14, power master unit 150, accessories such as accessory 31, and could transmit directly to train engines instead of through the tracks. Such a transmission directly to the train engine could be used for newer engines with a wireless receiver, while older train engines would continue to receive commands through the tracks.

Train Circuitry

Figure 2:
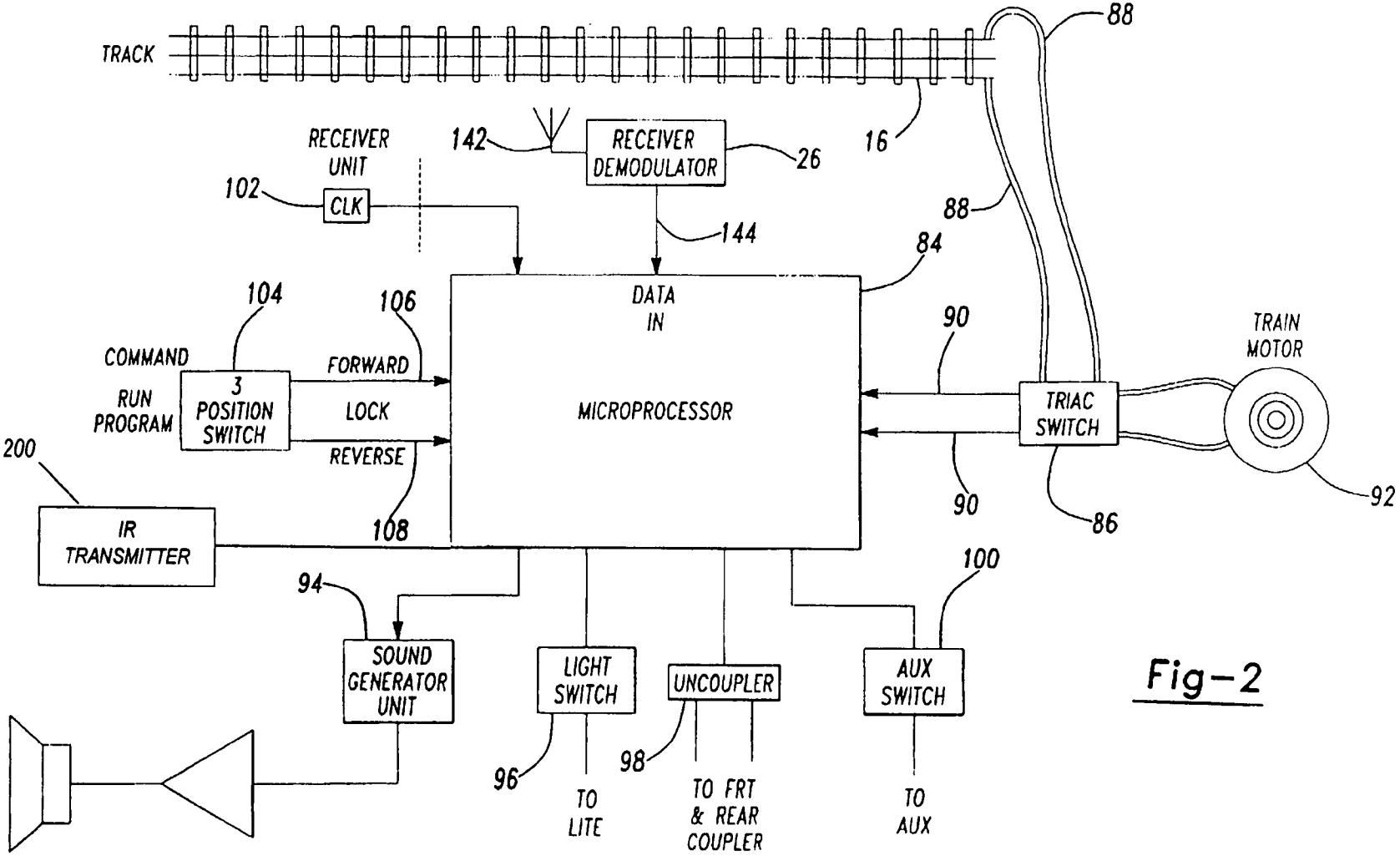
FIG. 2 is a block diagram of an example of the circuitry inside of a train according to an embodiment of the invention.

FIG. 2 is a block diagram of an example of the circuitry inside of a train 24 running on track 16. A receiver and demodulator circuit 26 picks up the electromagnetic field signals, and provides them to a data input of a microcontroller 84. The receiver can be an FM receiver chip and the microcontroller can be a microprocessor. The microprocessor controls a triac switching circuit 86. One side of the triac switches are connected to the train tracks through leads 88 which pick up power physically from the track. When activated by control signals from microcontroller 84 on lines 90, the triac switching circuit 86 will provide power to train motor 92, which moves the wheels of the train.

The microcontroller also has separate, dedicated output pins which can control a sound generator unit 94, a light switch 96, a coupler 98 and an auxiliary switch 100. The microcontroller is powered by an on-board clock 102.

A three position manual switch 104 is provided. In a first mode, the switch indicates on a line 106 that the train is to start in the forward direction. When in a second position, a signal on a line 108 indicates that the train is to start in the reverse direction. When the switch is in-between the two lines, in a "lock" mode, the microcontroller knows to start the train in the last direction it was in.

The same switch 104 can perform a second function. When a control command is received by the microcontroller, it knows to use the position of switch 104 to indicate either a "run" mode when the switch is in position 106, or a "program" mode when the switch is in the position on line 108.

In order to program an address into a train, the manual switch is moved into the program mode and the train is put on the track. The remote unit is then used to provide an address program command with a designated address for that train. This command is received by the receiver 26 and provided to microcontroller 84, which knows it should write into its memory that address as its designated address. Thereafter, in the run mode, the microcontroller will respond only to commands associated with that address.

An IR transmitter 200 is connected to the microprocessor. This transmitter periodically emits the train's information packet which includes its ID, engine number and engine road name under the control of the microprocessor.

Direct Wireless ID

Figure 3:
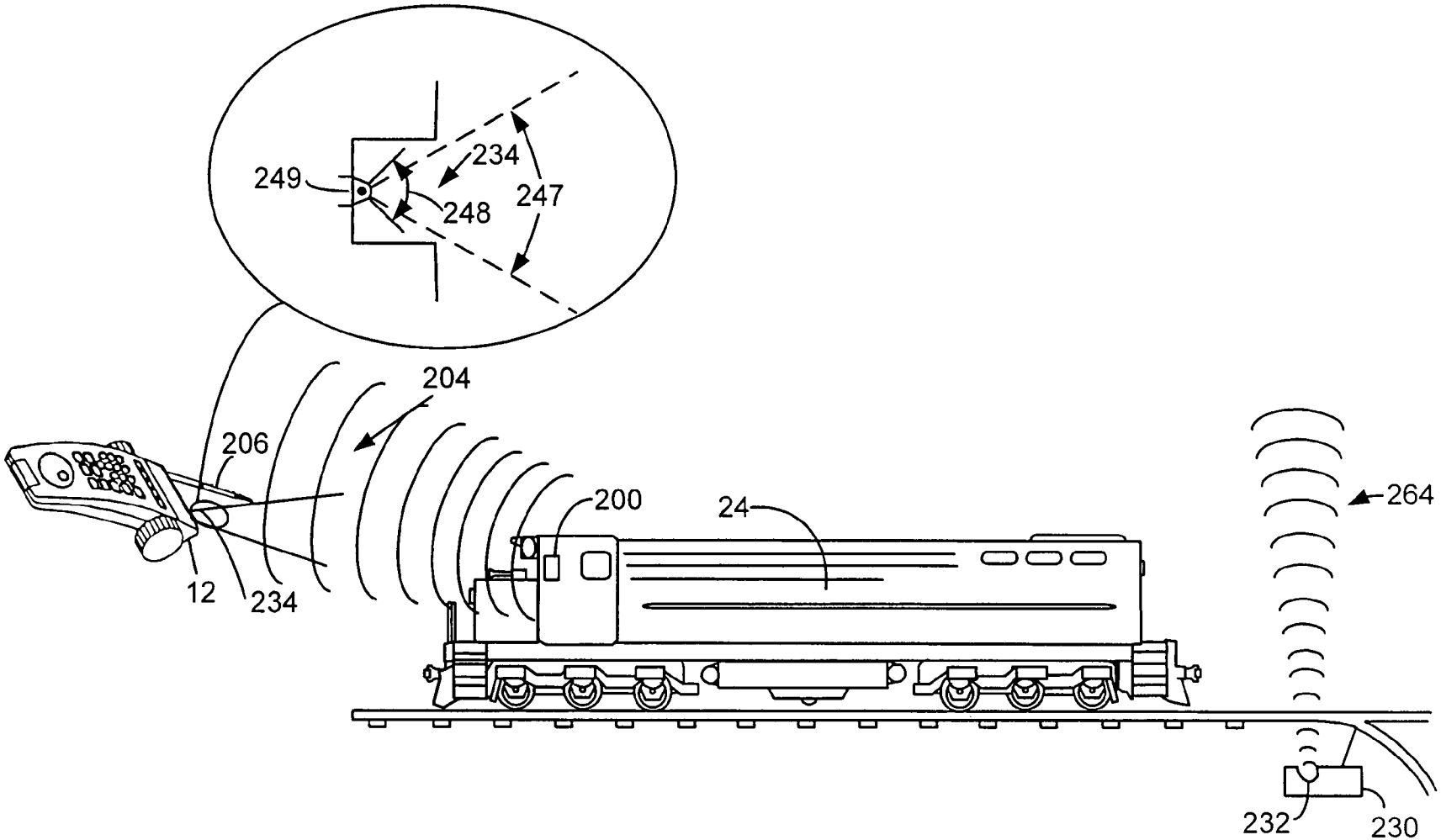
FIG. 3 is a drawing illustrating the transmission between the train and the remote according to an embodiment of the invention.

FIG. 3 illustrates a train locomotive 24 with an IR transmitter 200 mounted behind its windshield. The receiver is mounted in a recess 234 which acts to limit the field of the reception to a narrow band as illustrated by transmission lines 204. The standard viewing angle 248 of the IR receiver 249 is further limited by the use of a recess creating a further reduction in the viewing angle represented by 247. The transmission is then received by an IR receiver of remote unit 12. Alternately, the IR transmitter could be placed in other locations on the locomotive or on other cars of the train. Alternately, the transmitter could be recessed. This would be useful for RF transmission from the train engine to the remote control.

FIG. 3 also shows an example of an accessory, a switch 230 for controlling selection between two different portions of the track. The switch has its own IR transmitter 232, which can be driven by a simple integrated circuit with either DIP switches or serializing a unique number representing the encoded ID to be transmitted, or some other mechanism. Alternately, instead of a transmitter 232, a IR reflective strip with the ID code can be placed on the device, with the remote control device having a transmitter and receiver for bouncing an IR signal off of the accessory to determine its ID code.

Figure 4:
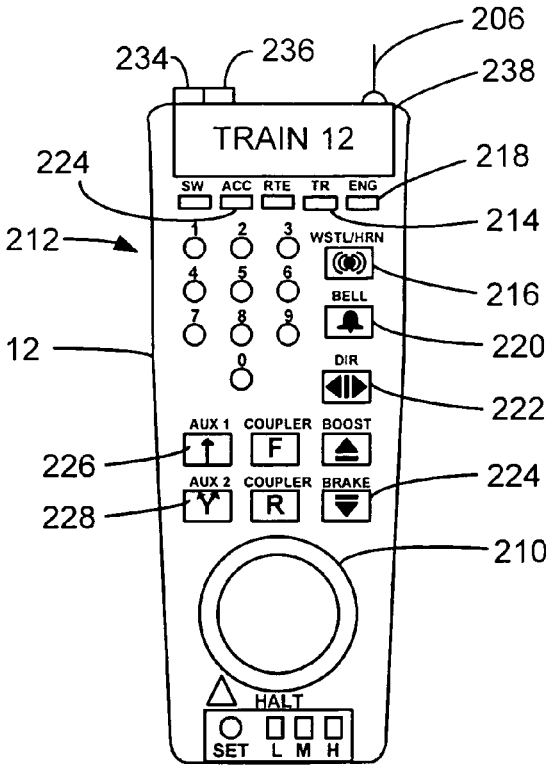
FIG. 4 is a diagram of a remote control unit which can be used in the embodiment of the invention.

FIG. 4 is a diagram of remote control device 12 illustrating some of its buttons and controls. The remote control includes a throttle dial 210 and a numeric keypad 212. A number of other control buttons are provided. For example, a train button 214 is pressed to select a particular train, with the train ID number then being punched in on the keypad 212. Once the train has been selected, certain functions of the train can be activated by pressing other buttons, such as a whistle/horn button 216, an engine button 218 for activating an engine, a bell button 220, a direction button 222 for controlling the direction of a train and a brake button 224. Also provided are an accessory button 224 which can select a particular accessory, such as a signal light or a switch. This can be selected by pressing the button, then selecting the number of the particular accessory. The functions of the accessory can then be controlled by pressing auxiliary buttons 226 and 228.

Remote control device 212 includes an IR receiver 234, and optionally a transmitter 236 for reflecting IR signals off of a reflective IR coated strip, to be detected by IR detector 234. Antenna 206 is used for RF transmissions either to a base unit or directly to trains and accessories.

In one embodiment of the invention, the user simply holds the remote close enough to the selected device (engine, accessory) so that the appropriate device has been detected. To send a command to that particular device, the user only needs to directly push one of the command buttons, selecting which type of device is being operated without entering the device ID. The ID will have been received, with the processor automatically sending that ID with the command that is transmitted. Another way of indicating the ID would be to press the learn button. This button would open the remote to look for the ID being transmitted.

In another embodiment, a display 238 is provided. In this embodiment, when the remote is pointed at a particular train, the ID would be received from the train, and the processor inside the remote will display the train ID number, as well as an alpha display indicating that it is a train, and not an accessory. Other displays could be used for accessories, such as an alpha display of the word "switch" with the switch number. Thus, the user is given visual confirmation that the appropriate train accessory has been selected, and can then directly activate one of the other buttons, such as bell button 220, directional button 222, etc.

Figure 5:
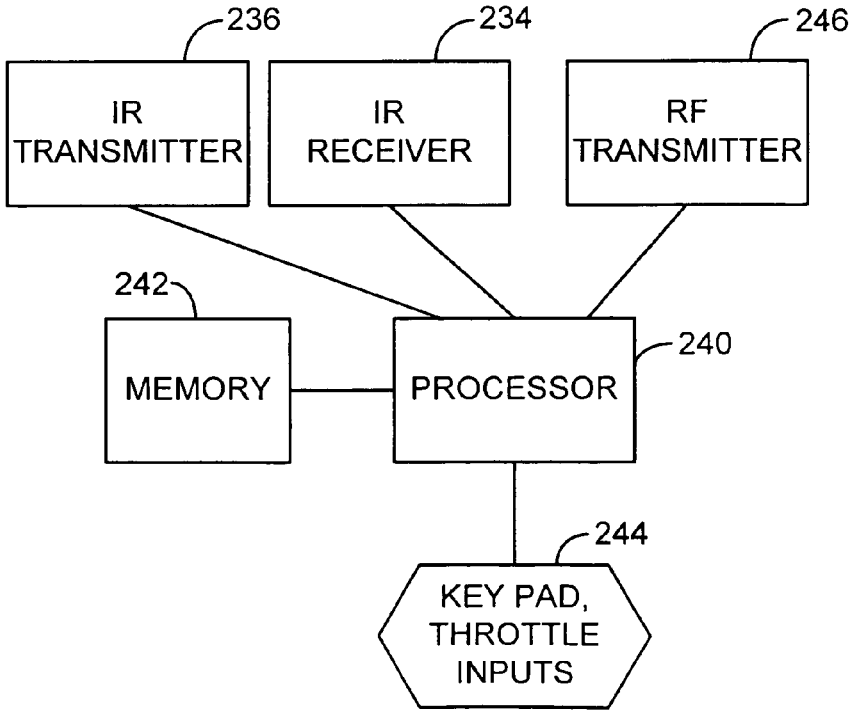
FIG. 5 is a block diagram of the electronic circuitry inside the remote control unit of FIG. 4.

FIG. 5 is a block diagram illustrating the electronics and the interior of remote control device 12 of FIG. 4. A processor 240 controls the remote control with a program stored in the memory 242. Keypad and throttle inputs 244 are provided to the microprocessor to control it. The microprocessor controls an RF transmitter 246 which connects to RF antenna 206 to transmit commands to a base unit or directly to trains and accessories. IR receiver 234 and IR transmitter 236 are also controlled by the processor.

As would be understood by those with skill in the art, the present invention may be embodied in other specific forms without departing from the essential characteristics thereof. For example, instead of an IR transmission, the transmission could be a separate RF frequency, spread spectrum, visible light, or any other wireless transmission method. Visible light might be used instead of, or in addition to the IR transmission, to visually guide the user as to where to hold the remote to intercept the ID. The user could turn the visible light function on with a control on the remote so that the light is only emitted when the user wants to select devices, so all the devices aren't flashing all the time. Accordingly, the foregoing description is intended to be illustrative, but not limiting, of the scope of the invention which is set forth in the following claims.

What is claimed is:

1. A method for identifying one of a plurality of devices in a model vehicle system, comprising:

positioning a remote control device near a first one of said devices while said first device remains operational in the model vehicle system;

transmitting an identifying signal (ID) from said first device to said remote control device via a first communication channel, wherein said remote control device is only capable of receiving said ID for said first device when said remote control device is placed within a narrow spatial field emanating from said first device with a limited viewing angle, so that said ID is not interfered with by transmissions from other devices; and associating said first device with the ID, so that only said first device responds to transmissions from said remote after said remote control device receives said ID;

wherein said ID is used to provide a command from said remote control device to said first device via a second communication channel that is separate from said first communication channel.

2. The method of claim 1, wherein said narrow spatial field is achieved by recessing a detector.

3. The method of claim 1, wherein said narrow spatial field is achieved by recessing a transmitter.

4. The method of claim 1 wherein said ID is an infrared signal.

5. The method of claim 1 wherein said first device repeatedly transmits the ID.

6. The method of claim 1 wherein said first device transmits said ID in response to a transmitted request from said remote control.

7. The method of claim 1 wherein said remote control device transmits a signal which is reflected off a reflective code on said device.

8. The method of claim 1 wherein said device is an accessory.

9. The method of claim 1 wherein said device is a model vehicle.

10. The method of claim 9 further comprising:

associating, in said remote control, at least one control input with a control function for said vehicle with said ID.

11. A method for identifying one of a plurality of model trains, comprising:

periodically transmitting from a first model train an ID for said first model train in a limited field infrared transmission having a limited view angle;

positioning a remote control device near said first model train while said first model train operates in a model train system so that only a transmission from said first model train is received by an infrared receiver in said remote control device;

associating, in said remote control device, at least one control input with a control function for said model train with said ID; and providing a command to said model train from said remote control device, using said ID, along a communication channel separate from said limited field transmission.

12. A model vehicle comprising:

a processor configured to receive commands from a remote control unit via commands received from a communication channel;

a transmitter mounted in said vehicle for directing a transmission of an identifying signal (ID) that can be received by said remote control unit independent of said communication channel while said vehicle is operating in a model vehicle system; and means for limiting a view angle of said transmission so that only a narrow transmission from a single vehicle is received by said remote control unit when positioned in a field of said transmission.

13. The model vehicle of claim 12 wherein said processor is programmed to periodically cause said ID associated with said model vehicle to be transmitted by said transmitter.

14. The model vehicle of claim 12 wherein said transmitter comprises an IR LED, and where said means for limiting the transmission of said transmission comprises a barrier around said LED formed by a recess in said model vehicle.

15. The model vehicle of claim 12 wherein said transmitter is mounted in a windshield of said vehicle.

16. The model vehicle of claim 12 wherein said vehicle is a train, and said communication channel is over the train tracks.

17. A remote control unit for controlling a plurality of model vehicles, comprising:

a processor configured to generate a plurality of commands to designated vehicles identified by IDs, in accordance with inputs provided by a user, over a first communication channel;

a receiver mounted in said remote control device, for receiving a transmission from said first model vehicle, separate from said communication channel, conveying an ID of said first model vehicle while said first model vehicle remains operational in a model vehicle system, wherein a field of view of said receiver has a limited view angle; and said processor being configured to send a command to said first model vehicle, over said first communication channel, using said ID received by said transmission, in response to a user input.

18. The remote control unit of claim 17 wherein:

said model vehicle is a model train;

said transmission is an IR transmission; and said first communication channel includes providing commands to said model train over the train tracks.

19. A system for controlling model vehicles, comprising:

a first model vehicle including a processor configured to receive commands via a first communication channel, a transmitter mounted in said first model vehicle for directing a transmission of an identifier (ID) that can be received independent of said first communication channel, and means for limiting a view angle of said transmission so that only a narrow transmission from the first model vehicle is received by a receiver positioned in said field of said transmission;

a remote control unit for controlling said model vehicles, including a processor configured to generate a plurality of commands to designated vehicles identified by respective IDs, in accordance with inputs provided by a user, over said first communication channel;

a receiver mounted in said remote control device, for receiving a transmission from said first model vehicle, separate from said communication channel, with the ID of said first model vehicle while said first model vehicle remains operational within a model vehicle system; and said processor being configured to send a command to said first model vehicle, over said first communication channel, using said ID received by said transmission, in response to a user input.

* * * * *